United States Patent [19]

Ikeuchi et al.

[11] Patent Number: 5,046,668

[45] Date of Patent: Sep. 10, 1991

[54] TWO-FLUID NOZZLE

[75] Inventors: Hiroshi Ikeuchi, Ashiaya; Norio Ohnishi, Nishiwaki, both of Japan

[73] Assignee: H. Ikeuchi & Co., Ltd., Osaka, Japan

[21] Appl. No.: 487,248

[22] Filed: Mar. 2, 1990

[30] Foreign Application Priority Data

Apr. 14, 1989 [JP] Japan ..... 1-96081

[51] Int. Cl.[5] ..... B05B 7/04

[52] U.S. Cl. ..... 239/432; 239/434.5; 239/597; 239/601

[58] Field of Search ..... 239/432, 434.5, 597-599, 239/601

[56] References Cited

U.S. PATENT DOCUMENTS

| | | | |
|---|---|---|---|
| 2,755,137 | 7/1956 | Hughf | 239/597 |
| 4,592,507 | 6/1986 | Benedict | 239/434.5 |
| 4,646,973 | 3/1987 | Focaracci | 239/432 |
| 4,646,977 | 3/1987 | Iwamura et al. | 239/601 |

FOREIGN PATENT DOCUMENTS

| | | | |
|---|---|---|---|
| 59-179259 | 10/1984 | Japan . | |
| 2193118 | 2/1988 | United Kingdom | 239/432 |

OTHER PUBLICATIONS

Patent Abstracts of Japan, Unexamined Applications, Feb. 19, 1985, vol. 9, No. 38 (M-358) [1761].

*Primary Examiner*—Andres Kashnikow
*Assistant Examiner*—Karen B. Merritt
*Attorney, Agent, or Firm*—Wenderoth, Lind & Ponack

[57] ABSTRACT

A two-fluid nozzle, constituted by a gas inlet and a liquid inlet; a first mixing chamber having a gas feed element connected to the gas inlet for feeding a gas along an axial center line in a direction toward a discharge end of the nozzle and having a liquid feed element for feeding a liquid into the outer periphery of the gas at the downstream end of the gas inlet; a substantially uniform diameter rectifying chamber opening out of the first mixing chamber and extending along the axial center line toward the discharge end for receiving the mixture of gas and liquid and conveying it therealong; a second mixing chamber having a larger diameter than the rectifying chamber and into which the downstream end of the rectifying chamber opens, the second mixing chamber having a wall face at the downstream end thereof spaced from and opposed to the downstream end of the rectifying chamber and against which the outer peripheral portion of the mixture of gas and liquid discharged into the second mixing chamber from the rectifying chamber collides; and a nozzle tip on the downstream end of the second mixing chamber having a discharge opening at a discharge end thereof and a jetting chamber extending along the axial center line from the second mixing chamber to the discharge opening, the nozzle tip having an end face portion in which the discharge opening is located having a hemispherical shape and a cylindrical peripheral wall around the base of the hemisphere, the discharge opening being a uniform width slit extending across the hemispherical shape end face portion and into the cylindrical peripheral wall in a diametrically extending plane, the ends of the slit having a circular arc or a V-shape.

2 Claims, 6 Drawing Sheets

TWO-FLUID NOZZLE

BACKGROUND OF THE INVENTION

The present invention generally relates to a two-fluid nozzle, and more particularly, to a highly efficient two-fluid nozzle, which is adapted to effect a wide-angle, fanshaped atomized spray by a gas-liquid mixing system, the spray being used in cooling high-temperature objects, etc., and especially, which is adapted to effect atomization having uniform drop diameter, liquid amount and air amount across the entire spray pattern, and also which does not cause clogging, etc.

Conventionally, there has been provided such a two-fluid type nozzle as shown in, for example, FIG. 10 which is capable of forming a spray of atomizing gas and water mist across a comparatively wide range of surfaces of an object. The nozzle is composed of a nozzle 3 with a liquid inlet 1 and a gas inlet 2 formed therein, a nozzle 4 for liquid, a nozzle 5 for mixed liquid and gas, a retainer ring 6 mounted in the nozzle body 3 for retaining the liquid nozzle 4 and the mixed liquid and gas nozzle 5 in the nozzle, and a rubber O ring 7 interposed between the nozzle 3 and the liquid nozzle 4.

In the nozzle, the liquid is fed into the axial center portion of the nozzle through the liquid nozzle 4 from the nozzle 3. The gas passes through a flow passage 8 around the outer peripheral portion of the liquid nozzle 4, and is introduced into the mixed liquid and gas nozzle 5 through an orifice 9 formed in a flange on the liquid nozzle 4. The gas is mixed with the outer peripheral portion of the liquid ejected from the liquid nozzle in a gas-liquid mixing chamber 10 of the nozzle 5. The mixed gas and water are atomized by a slit-shaped discharge opening 12 in a hemispherical-shaped nozzle end face 11 as a mist of water and gas.

A two-fluid nozzle having a construction substantially similar to the above-described construction is shown in FIG. 11 and feeds the liquid into the central portion, feeds the gas into the outer peripheral portion thereof so as to mix them in the gas-liquid mixing chamber 10 near the discharge opening 12, jets the mixture from a discharge opening 12 which is the same shape as the discharge opening 12 shown in FIG. 10.

The two-fluid nozzle of the above-described construction has problems since the system feeds the liquid to the axial center portion and mixes the gas into the outer periphery of the liquid, the atomized drops become larger in diameter at the central portion of the spray and become smaller at the outer peripheral portion as shown in FIG. 12, thus resulting in unequal drop diameters across the spray.

Since the orifice 9 through which the gas enters the mixing chamber 10 is narrow, foreign materials such as dust and so on contained in the gas tend to clog the orifice 9, which is likely to cause the flow amount to be decreased and to cause a pressure loss. Since the air jetted from the orifice 9 collides with the corner portion 5*a* of the inner wall of the mixed gas and liquid nozzle 5, turbulence is caused and the foreign materials in the gas are likely to be accumulated in space 5*a'* adjacent the corner portion 5*a*. Especially in the conventional embodiment shown in FIG. 10, the above-described defects are serious, and the nozzle of the above-described construction further has many bent portions in the flow passage for the liquid so as to cause a pressure loss. The reduction of flow of the gas, and the pressure loss lower the negative pressure relative to the gas pressure at the jetting opening 4*a* of the liquid nozzle 4 and lower the ability of the liquid to mix the gas therein.

Further, since a rubber O ring is used, the durability of the nozzle is reduced, and also the number of parts is increased.

Further, in the above-described conventional nozzle, the shape of the discharge opening 12 in the nozzle end face 11 is a slit extending along a line in X—X direction of the nozzle axial line as shown, and has the end face 12*b* at the end of the side faces 12*a* perpendicular to the side faces in a Y—Y direction. The end face 12*b* is shaped as shown, which causes a drawback that the distribution of the gas-liquid becomes unequal and also the diameter becomes unequal. This is proved by experiments as described later conparing such a nozzle with a nozzle according to the present invention.

With respect to the shape of the discharge opening, a discharge opening can be a V-shaped slit 12' extending from the tip end position of the nozzle end face 11 to the side thereof as shown in, for example, FIG. 8(B) (disclosed, for example, in Japanese Laid-Open Patent Application Tokukaisho No. 56-100883).

The above-described V-shaped slit causes a drawback that the range of the atomized spray in which uniform distribution of water drops exist becomes narrower. This is proved by experiments as described later comparing such a nozzle with a nozzle according to the present invention. Even in a nozzle provided with the discharge opening 12', the passage of the fluid through the nozzle becomes complicated and foregin materials are eaily accumulated and cause pressure loss, and the two fluids are mixed immediately before the discharge opening, with the drawback that the mixing is not effected sufficiently, and the drop diameters are not uniform.

SUMMARY OF THE INVENTION

Accordingly, an essential object of the present invention is to provide a two-fluid nozzle which is free from the drawbacks of the above-described conventional nozzles, and which is capable of making the drop diameter, the liquid amount and the air amount equal across a wide range.

Another important object of the present invention is to provide a two-fluid nozzle of the above-described type which is capable of effecting a uniform atomizing operation across a wide range.

In accomplishing these and other objects, according to the preferred embodiments of the present invention, there is provided a two-fluid nozzle which has an improved shape of the discharge opening. Namely, the present invention provides a two-fluid nozzle wherein the end face outer wall portion of the nozzle tip in which the discharge opening is formed is hemispherical and has a cylindrical peripheral side wall portion connected adjacent to the base thereof, a constant width discharge slit is provided extending across the hemispherical end face portion from the center of the end face into the opposite cylindrical peripheral side wall portion, and also, the end portion of the discharge opening in the cylindrical peripheral portions is circular or V-shaped.

Also, the present invention provides a system of feeding the gas into the axial center portion of the nozzle, and also mixes the liquid near the feed point from the outer peripheral portion of the gas so as to circulate the mixture of gas and water along the axial center line within the nozzle for mixing the gas with the liquid within the nozzle.

Specifically, the two-fluid nozzle of the present invention has a first mixing chamber at the inlet end in which liquid is fed into the outer periphery gas which is fed along the axial center line so as to mix them, a rectifying chamber which communicates with the first mixing chamber in which the mixed fluid is circulated toward the discharge end along the axial center, a second mixing chamber having a large diameter at the discharge end of the rectifying chamber and having a wall face at the discharge end against which the fluid in the outer peripheral portion of the mixture of fluid discharged into the second mixing chamber from the rectifying chamber collides, and a tip having a discharge opening and a jetting chamber communicating between the discharge opening and the second mixing chamber.

In the preferred embodiments of the present invention, the ends of the slit-shaped discharge opening are circular or V-shaped so as to make the atomization uniform and wide in the spray pattern. After the gas and liquid mixture mixed in the first mixing chamber has been circulated through the rectifying chamber, it is discharge into the second mixing chamber. The outer peripheral portion of the gas-liquid mixture is forced to collide against the wall face, so that the large diameter water drops in the outer peripheral portion are broken up so as to be made smaller in diameter to make the drop diameter uniform throughout the mixture. Therefore, approximately uniform drop diameter, amount of air and amount of liquid is effected across the whole range of the spray pattern.

BRIEF DESCRIPTION OF THE DRAWINGS

These and other objects and feature of the present invention will become clear from the following description of the preferred embodiments thereof with reference to the accompanying drawings, in which.

DETAILED DESCRIPTION OF THE INVENTION

Figure 1:
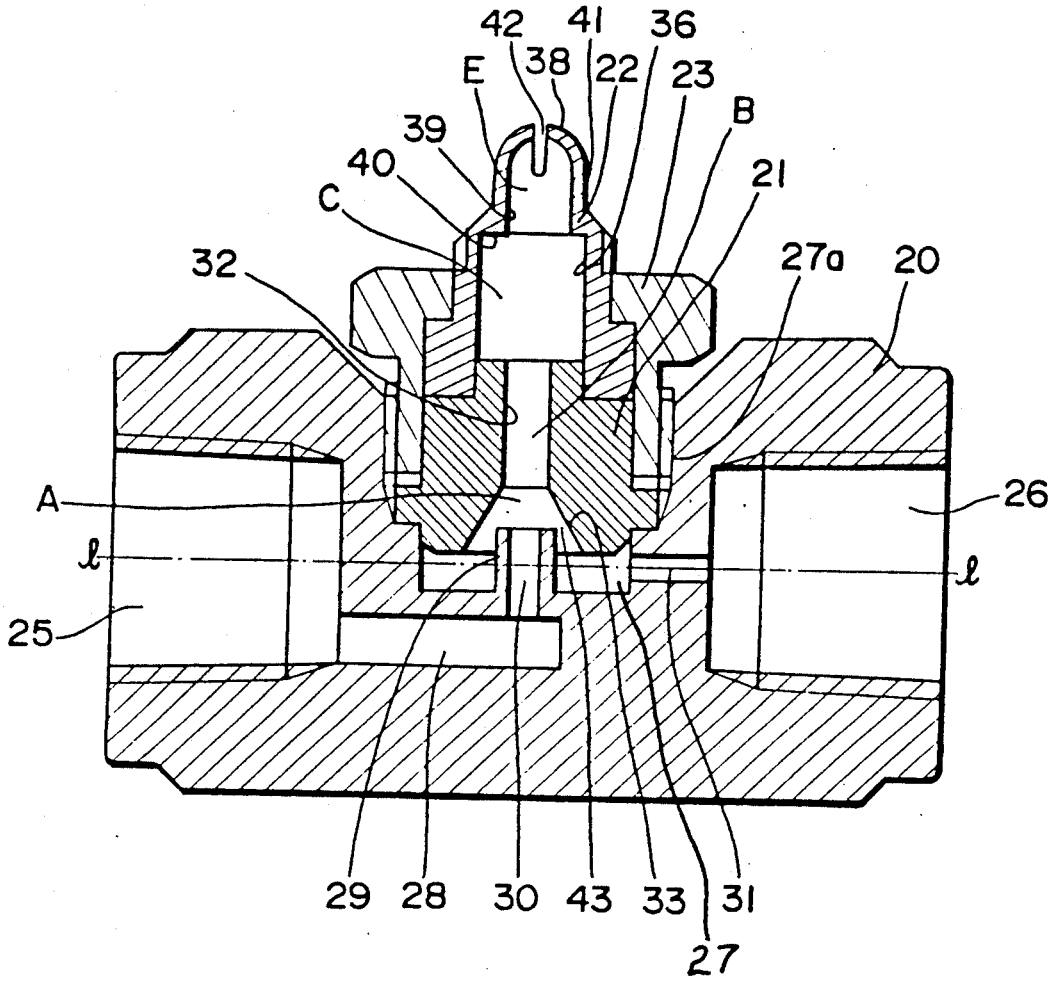
FIG. 1 is a sectional view showing an embodiment of a two-fluid nozzle in accordance with the present invention.
Figure 2:
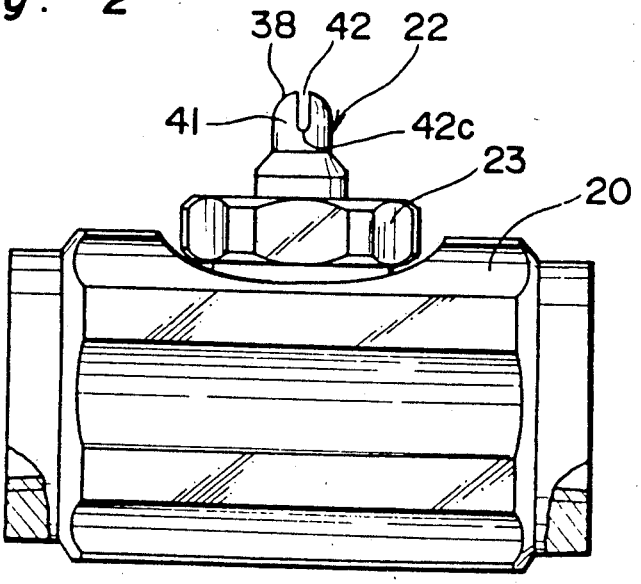
FIG. 2 is a side elevation view of the nozzle shown in FIG. 1.
Figure 3:
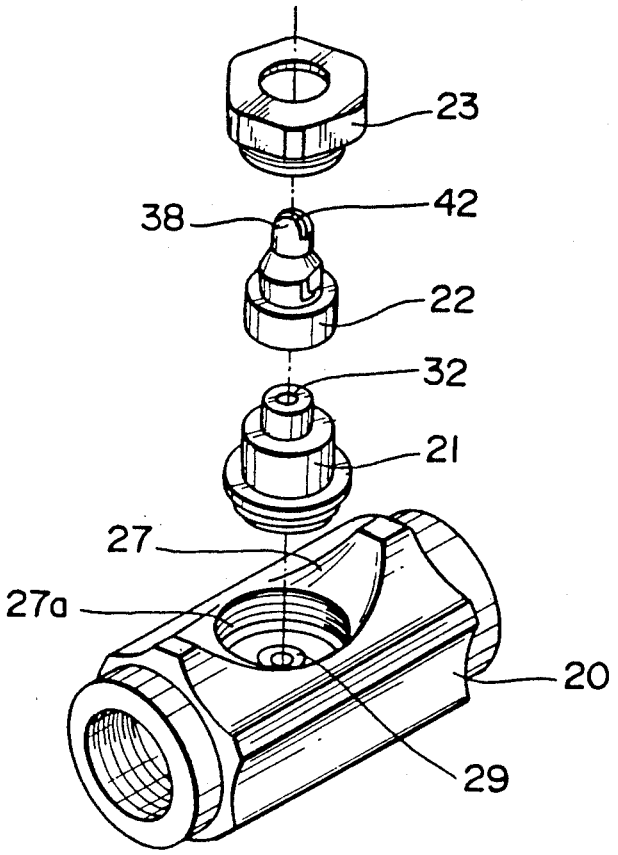
FIG. 3 is an exploded perspective view thereof.

Before proceeding with the description of the present invention, it is to be noted that like parts are designated by like reference numerals through the accompanying drawings.

Referring now to the drawings, there is shown a two-liquid nozzle according to a preferred embodiment of the present invention, which includes a main nozzle body 20, a core 21, a tip 22, and a cap 23.

The main nozzle body 20 is approximately cylindrical in shape, has large-diameter opening portions 25, 26 formed respectively in the left and right end portions thereof, with the opening portions being for connection with a gas feed pipe and a liquid feed pipe (not shown), has a concave recess 27 provided centrally of the axial length with the upper end thereof being open, has a female threaded portion 27*a* on the inner peripheral face of the concave recess 27 into which the cap 23 is threaded. A small diameter gas inlet passage 28 is drilled at a location under the axial core line l—l, and communicates with the opening portion 25 to which the gas feed pipe is to be connected. The gas inlet passage 28 extends to beneath the middle of the concave recess 27 in the central portion of the main nozzle body 20 and then upwardly to open out of the bottom center of the concave recess. An annular partition wall 29 around the outer periphery of the opening projects into the concave recess to form an orifice 30. A small diamater liquid inlet passage 31 extends along the axial core line l—l, i.e. above the gas inlet passage 28, from opening portion 26 and opens through the outer peripheral wall of the concave recess 27.

A core 21 is positioned within the concave recess 27, and a tip 22 is engaged with a tip end portion of the core 21. A cap 23 is screwed into the recess 27 in the main nozzle body 20 and the cap 23 is engaged with the core 21 and holds the tip 22 on the core 21 so as to constitute the nozzle.

The core 21 engaged in the concave recess 27 of the main nozzle body 20 has a downwardly and outwardly tapered conical inlet 33 to the lower end of a small diameter hole 32 drilled along the axis of the core 21. The wall of the tapered inlet surrounds and is spaced from the partition wall 29. The space between the outer edge of the top end of the partition 29 and the wall of the tapered inlet 33 is narrow. The narrow space functions as an orifice 43. By this construction, the gas is jetted into the central portion of the tapered inlet 33 from the orifice 30, and the liquid is jetted into the outer peripheral portion of the gas from the orifice 43 so as to feed the liquid into the outer peripheral portion of the gas to effect a mixing operation in a first mixing chamber A constituted by the inner portion of the tapered inlet 33. The small diameter hole 32 communicating with the tapered inlet 33 is comparatively long and constitutes a long rectifying chamber B which functions to sufficiently effect the rectifying operation of the mixed fluid mixed in the first mixing chamber A.

Figure 4:
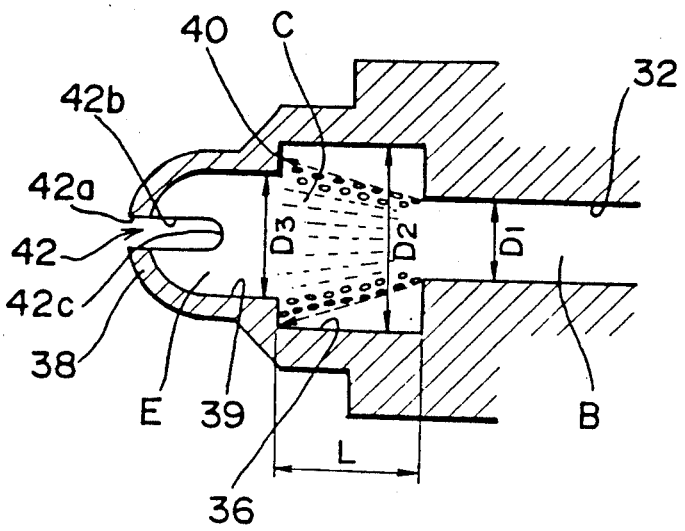
FIG. 4 is a schematic enlarged sectional view of the essential portions of the nozzle of FIG. 1.

A second mixing chamber C is provided in the tip 22 adjacent the tip end of the core 21 formed by a hole 36 larger in diameter than the rectifying chamber B and into which the rectifying chamber B opens as shown. A hemispherical end face outer wall portion 38 is provided on the tip end of the tip 22 as shown, and a cylindrical outer peripheral wall portion 41 is connected between the end face outer wall portion 38 and the part of the tip 22 which defines hole 36 and the wall portion 41 defining an intermediate diameter hole 39 having a circular cross-section. The intermediate diameter hole 39 communicates with the tip end of the large diameter hole 36 to form a jetting chamber E, and a lateral wall face 40 is formed between the outer peripheral portion of the intermediate diameter hole 39 and the outer peripheral portion of the large diameter hole 36. The wall face 40 is at the outer end of the second mixing chamber C so that the fluid on the outer peripheral portion of the mixed fluid jetted from the rectifying chamber B into the second mixing chamber C is adapted to collide against the wall face 40. The diameter of the rectifying chamber B is D1, the diameter of the second mixing chamber C is D2 and the length is L, and the diameter of the jetting chamber E is D3 as shown in FIG. 4, and they are in the relationship of $D1 \leqq D2$, $D3 \leqq D2$. The fluid in the outer peripheral portion of the fluids being mixed which jets into the second mixing chamber C from the rectifying chamber B through the length L of the second mixing chamber C collides against the wall face 40.

The discharge opening 42 is formed by the slit 42 in the hemispherical end face portion 38 extending into the outer peripheral side wall portions 41 on both sides of the tip 22 from the vertex portion of the hemisphere in a diametrical plane toward the nozzle. As shown in FIG. 4, the discharge opening 42 is provided so that the vertex portion **42*a* and the opposite side face portions 42*b* define a uniform width slit, and the end portions 42*c*** of the slit are circular in shape.

The shape of the end portion **42*c* of the discharge opening 42** is not restricted to a circular arc shape, but may be a V-shaped acute angle.

The operation of the two-fluid nozzle of the above-described construction will be described hereinafter.

The gas (air in the present embodiment) flowing in from the gas inlet opening 25 is jetted into the first mixing chamber A from the orifice 30 in the central axial portion of the nozzle, the liquid (water in the present embodiment) flowing in from the liquid inlet opening 26 into the outer peripheral portion of the recess 23 around the partition wall 29 is jetted from the orifice 43, so that the water is mixed into the outer peripheral portion of the air.

Although the air and water is mixed almost completely by the mixing operation in the first mixing chamber A, the drops of water become comparatively larger in the outer peripheral portion, and become smaller in the central portion. In this condition, the mixed liquid flows into the rectifying chamber B. In the rectifying chamber B, the portion of the gas and water mixture which has the large drops of water is circulated along the inner wall and the portion of the gas and water mixture which has the smaller drops of water is circulated along the central portion.

The gas and water mixture which is jetted from the end of the rectifying chamber B into the second mixing chamber C with the large diameter is diffused as shown in FIG. 4, so that the portion of the mixture on the outer peripheral portion collides against the wall face 40 on lthe front face. Therefore, the large drops of water in the outer peripheral portion of the mixture are broken up into smaller drops with approximately an equal drop diameter to the water drops in the central portion of the mixture. The gas and water mixture which now has drops all of which are small in diameter flows from the discharge opening 42 into the jetting chamber E with the small diameter. The jetted gas and water mixture becomes a spray with a pattern of a wide-angle fan due to the shape of the discharge opening 42, and the diameter of the water drops remains equal, and both the amount of air and the amount of liquid become almost equal across the whole spray pattern as shown by the experiments to be described later.

Figure 13:
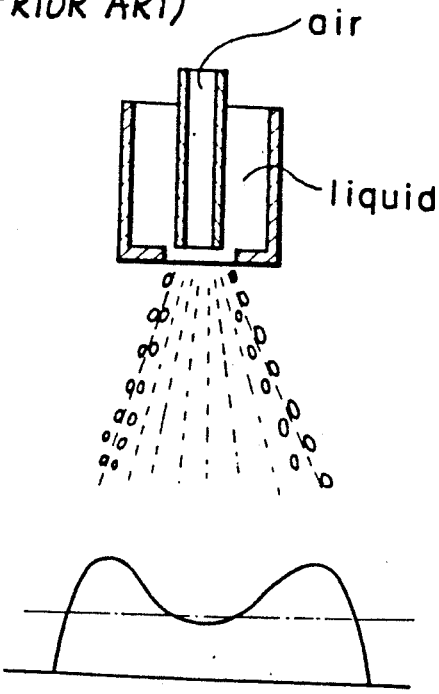
Fig. 13 (PRIOR ART)
FIG. 13 is a diagram showing the drop diameter where the gas is fed into the nozzle central portion and the liquid is mixed with the outer periphery of the gas.

In a gas-liquid mixing nozzle of the type in which the gas is fed into the central portion of the nozzle, and the liquid is fed into the outer peripheral portion thereof, it is natural that the diameter of the drops of water in the outer peripheral portion of the mixed liquid and gas are larger. If some means of causing the large liquid drops in the outer peripheral portion to be broken up to make the diameter thereof smaller, such as the colliding with the wall 40 as in the present invention, is not used, the diameter of the drops on the peripheral edge portion of the spray pattern will remain larger as shown in FIG. 13. In the present invention, the water drops are caused to collide against the wall face 40 as described hereinabove, the drops with a diamater larger than the diameter of the drops shown outside the one dot chain lines in FIG. 13 are broken up so that the drop diameter is made smaller.

(Experiment 1)

Figure 5A:
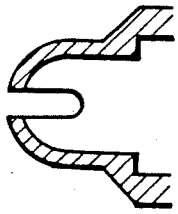
FIGS. 5(A), (B), and (C) are sectional views each showing a shape of a discharge opening.
Figure 5B:
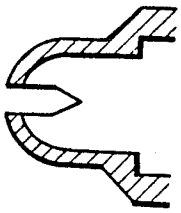
Figure 6A:
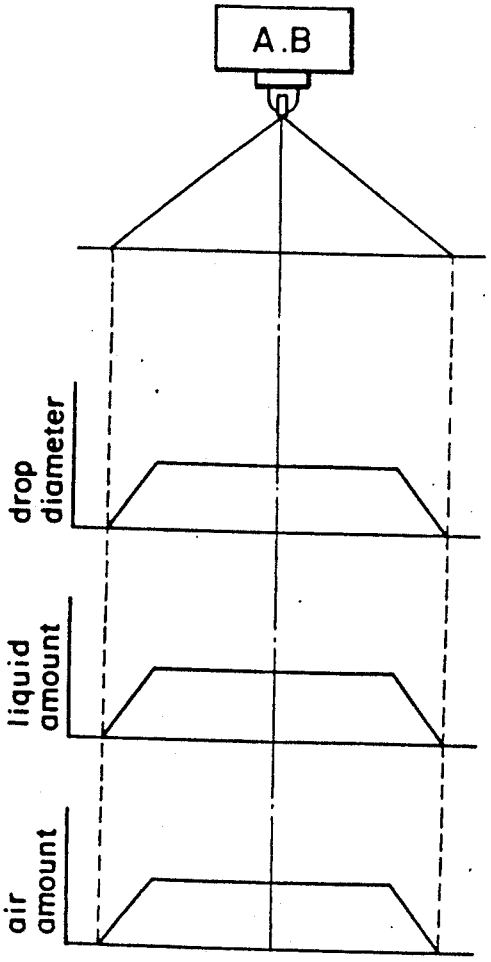
FIG. 6(A) and FIG. 6(B) are diagrams each showing the results of an experiment 1, comparing the drop diameter, the amount of liquid and the amount of air in the spray pattern for the nozzle of the present invention and a conventional nozzle provided with the discharge openings having the shapes shown in FIGS. 5(A)–5(C)
Figure 6B:
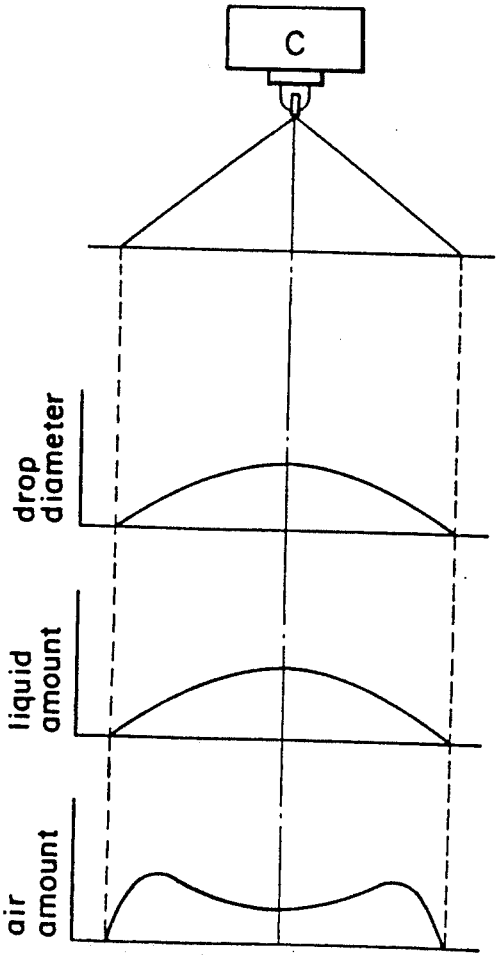
Fig. 6(B) (PRIOR ART)
Figure 7:
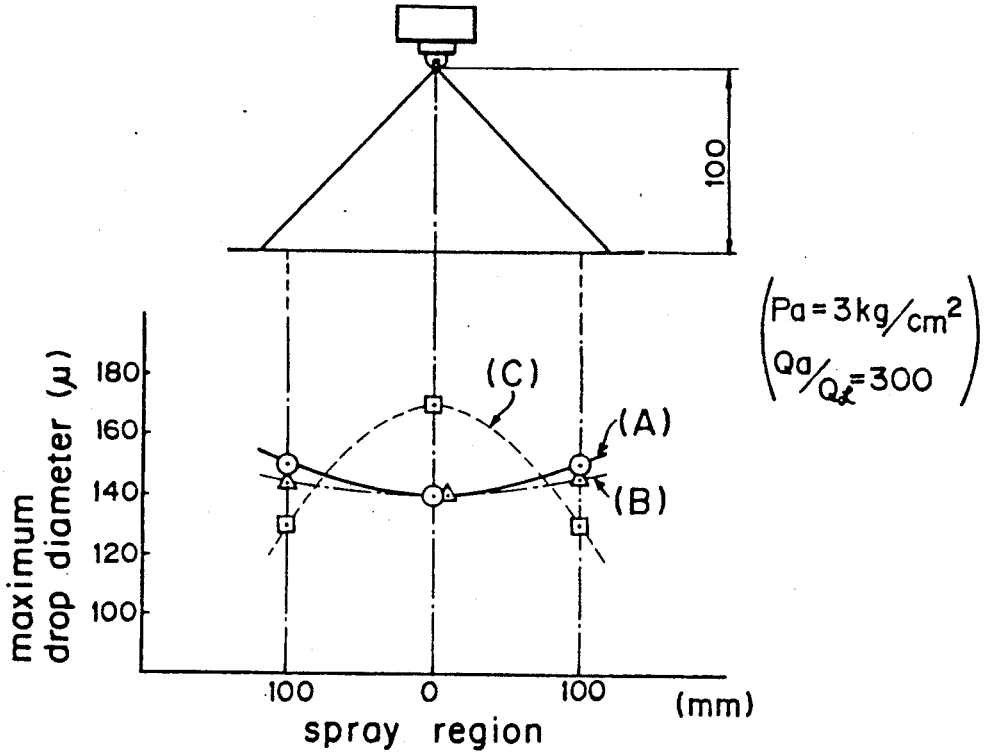
FIG. 7 is a diagram showing the results of an experiment 2, wherein the maximum drop diameters are compared.
Figure 12:
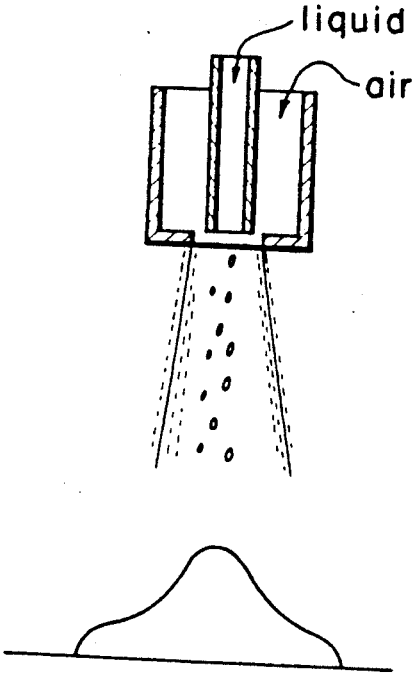
Fig. 12 (PRIOR ART)
FIG. 12 is a diagram showing the drop diameters in a spray pattern in a nozzle where the liquid is fed into the central portion of the nozzle and the gas is fed into the outer peripheral portion of the liquid for the mixing operation.

An experiment for comparing the performance of a nozzle according to the present invention and the performance of the nozzle shown in FIG. 12 produced the results shown in FIGS. 6 and 7. Namely, in the nozzle according to the present invention, wherein the shape of the discharge opening 42 was as shown in FIG. 5(A) with the end **42*c* of the opening circular, the drop diameter, the amount of liquid and the amount of air were uniform over a range wider than just the central portion of the spray pattern, as shown in FIG. 6(A). Even when the end portion 42*c* of the discharge opening 42 was cut into a V-shape as shown in FIG. 5(B), the distribution was uniform across almost the entire region of the spray pattern as also shown in FIG. 6**(A).

Figure 10:
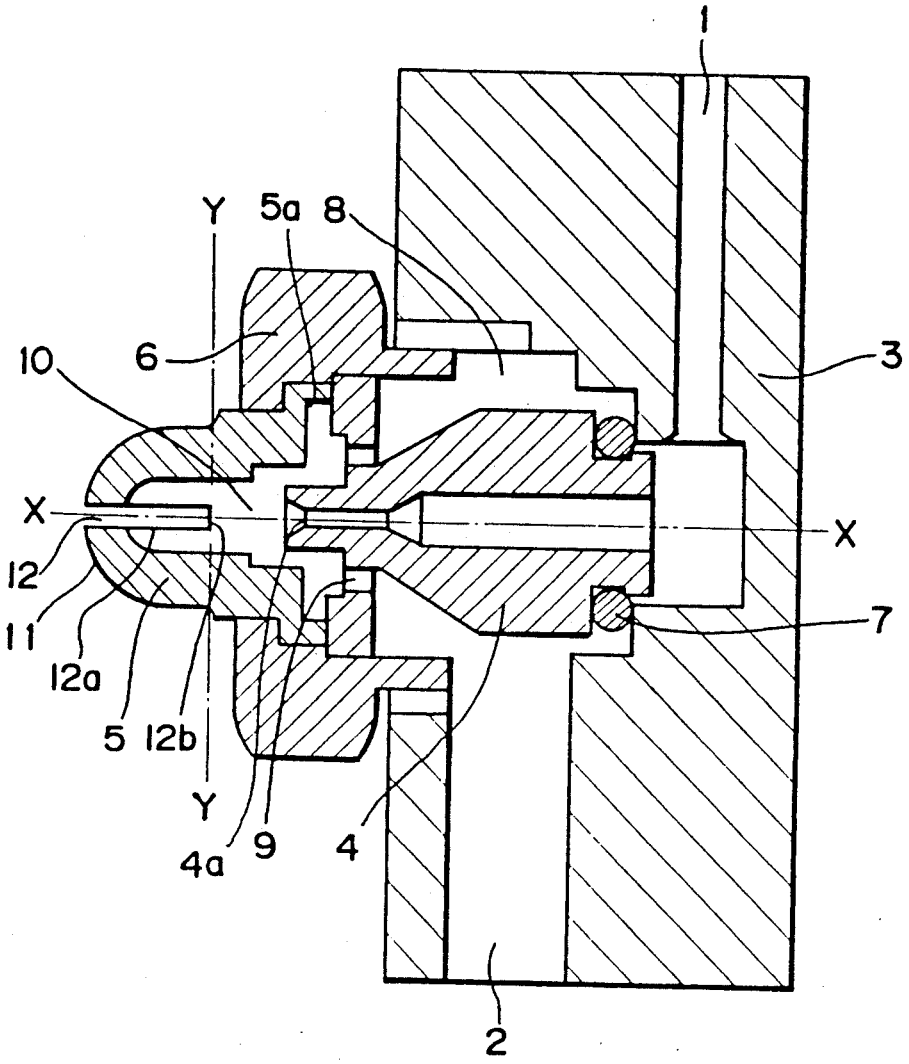
Fig. 10 (PRIOR ART)
FIG. 10 is a sectional view showing a conventional two-fluid nozzle.
Figure 11:
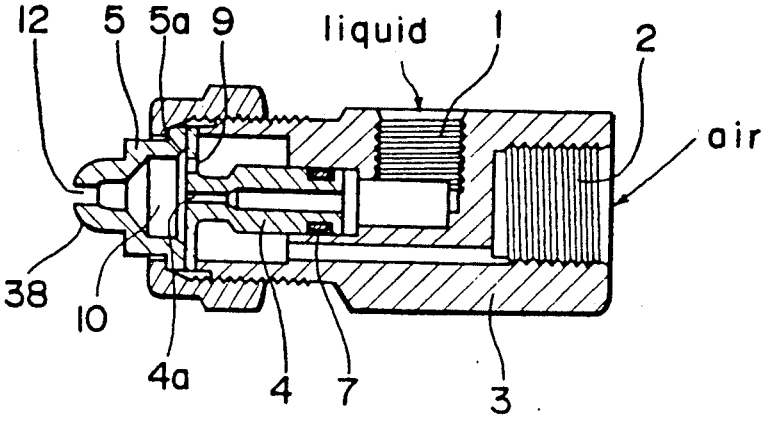
Fig. 11 (PRIOR ART)
FIG. 11 is a sectional view showing a further conventional two-fluid nozzle.

In the nozzle of the type shown in FIG. 10, and where the end portion **12*b* of the discharge opening 12 was as shown in FIG. 5**(C), i.e. at a right angle with respect to the side face portions of the slit, and the water was fed into the central portion of the nozzle and the air was fed into the outer peripheral portion lthereof, the central portion of the spray pattern had drops with a larger diameter, and the outer peripheral portion had drops with a smaller diameter, thus resulting in unequal drop size distribution. The amount of liquid was thus greater in the centrl portion, and was less in the outer peripheral portion. The amount of air was inversely less in the central portion, and was more in the outer peripheral portion, thus resulting in unequal distribution conditions.

(Experiment 2)

Figure 5C:
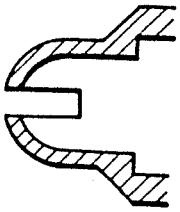
Fig. 5(C) (PRIOR ART)

Measurement of the distribution of water drop sizes for the nozzle in accordance with the present invention with the tips as shown in FIGS. 5(A) and 5(B) and of the distribution of drop diameters for the conventional nozzle embodiment with the tip shown in FIG. 5(C) produced the results shown in FIG. 7. Namely, the drop diameter was approximately uniform across the entire region of the spray pattern for the nozzle of the present invention with the tip of FIG. 5(A) or 5(B). In the conventional embodiment with the tip of FIG. 5(C), the drop diameter in the central portion was larger, the drop diameter in the peripheral portion was smaller, thus resulting in unequal drop diameter across the width of the spray pattern.

(Experiment 3)

Figure 8A:
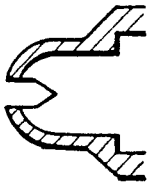
FIGS. 8(A) and 8(B) are sectional views showing the shape of discharge openings.

Comparative experiments were carried out for the effect of different shapes of the ends of the nozzle discharge opening and the lateral spread of the atomization. The discharge opening as shown in FIG. 8(A), when mounted on a nozzle in accordance with the present invention, and having the opening in the shape of the slit of a given width from the hemispherical-shaped end face wall portion to the side face wall portion, and also having the slit end portion in a V-shape, produced a spray pattern with uniform distribution of atomization over a width of almost 240 mm, as shown in FIG. 9(A). On the other hand, the nozzle as shown in FIG. 8(B), provided with a discharge opening 12' which was an overall V-shaped slit extending into the side face from the front end face, the extent of uniform distribution of atomization had a width of less than 150 mm, as shown in FIG. 9(B).

In this experiment, only the shape of the discharge opening was different, the other conditions being the same. Tips having different shapes were mounted on the same nozzle construction which was in accordance with the present invention.

Figure 8B:
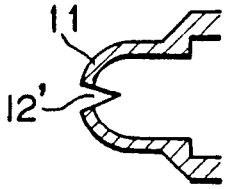
Figure 9A:
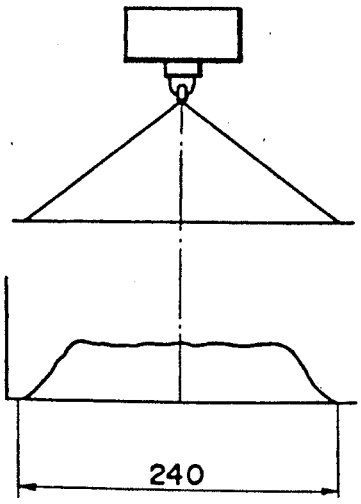
FIGS. 9(A) and 9(B) are diagrams showing the results of an experiment 3, wherein the patterns of atomization of the nozzles having discharge openings shown in FIGS. 8(A) and 8(B) are compared.
Figure 9B:
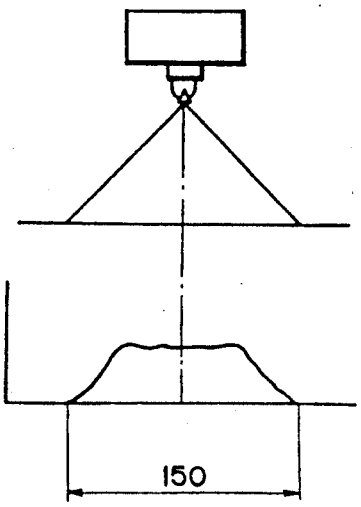

As shown in FIG. 8(B), when the V-shaped slit was used, the uniform distribution was possible only over a narrower atomization range as described hereinabove.

As is clear from the foregoing description, the two-fluid nozzle in accordance with the present invention has the following effects.

(1) Since the shape of the discharge opening to be formed by the slit has a constant width between the side face portion from the end face of the tip, and the end portion of the slit is circular or V-shaped, a spray pattern of uniform atomization and distribution of water drop diameter can be provided over a wide range.

(2) In a first mixing chamber, the gas and liquid are mixed by feeding liquid into the outer periphery of the gas which is fed into the central portion, and the mixed gas and liquid are jetted into a second mixing chamber of the large diameter through a long rectifying chamber. In the second mixing chamber, the outer peripheral portion of the gas-liquid mixture is adapted to collide against wall faces toward the outer end. Thus, the large diameter drops of water in the outer peripheral portion are broken up into drops with a small diameter. Thus, the drop diameter can be made uniform throughout the entire spray pattern.

(3) Since the gas and liquid are mixed in the first mixing chamber adjacent to the gas inlet and the liquid inlet, the mixture is circulated toward the discharge opening straight along the axial center line of the nozzle, so that the flow paths of both the liquid and the gas are simple, so that locations where clogging and vortex flows can occur are provided and there is no pressure loss.

(4) The nozzle of the present invention is composed of four parts. Since the number of parts is less as compared with that of a conventional nozzle, a reduction in cost can be effected.

(5) Since the rubber O ring used in the conventional nozzle is not used, there is considerable improvement in durability.

Although the present invention has been fully described in connection with the preferred embodiments thereof with reference to the accompanying drawings, it is to be noted that various changes and modification will be apparent to those skilled in the art. Such changes and modifications are to be understood as included within the scope of the present invention a defined by the appended claims unless they depart therefrom.

We claim:

1. A two-fluid nozzle, comprising:

a gas inlet means and a liquid inlet means;

a first mixing chamber having a gas feed means connected to said gas inlet means for feeding a gas along an axial center line in a direction toward a discharge end of the nozzle and having a liquid feed means for feeding a liquid into the outer periphery of the gas at the downstream end of said gas inlet means;

a substantially uniform diameter rectifying chamber opening out of said first mixing chamber and extending along the axial center line toward the discharge end for receiving the mixture of gas and liquid and conveying it therealong;

a second mixing chamber having a larger diameter than the rectifying chamber and into which the downstream end of the rectifying chamber opens, said second mixing chamber having a wall face at the downstream end thereof spaced from and opposed to the downstream end of said rectifying chamber and against which the outer peripheral portion of the mixture of gas and liquid discharged into the second mixing chamber from the rectifying chamber collides; and a nozzle tip on the downstream end of said second mixing chamber having a discharge opening at a discharge end thereof and a jetting chamber extending along the axial center line from said second mixing chamber to said discharge opening, said nozzle tip having an end face portion in which said discharge opening is located having a hemispherical shape and a cylindrical peripheral wall around the base of the hemisphere, said discharge opening being a uniform width slit extending across the hemispherical shape end face portion and into said cylindrical peripheral wall in a diametrically extending plane, the ends of said slit having a circular arc shape.

2. A two-fluid nozzle, comprising:

a gas inlet means and a liquid inlet means;

a first mixing chamber having a gas feed means connected to said gas inlet means for feeding a gas along an axial center line in a direction toward a discharge end of the nozzle and having a liquid feed means for feeding a liquid into the outer periphery of the gas at the downstream end of said gas inlet means;

a substantially uniform diameter rectifying chamber opening out of said first mixing chamber and extending along the axial center line toward the discharge end for receiving the mixture of gas and liquid and conveying it therealong;

a second mixing chamber having a larger diameter than the rectifying chamber and into which the downstream end of the rectifying chamber opens, said second mixing chamber having a wall face at the downstream end thereof spaced from and opposed to the downstream end of said rectifying chamber and against which the outer peripheral portion of the mixture of gas and liquid discharged into the second mixing chamber from the rectifying chamber collides; and a nozzle tip on the downstream end of said second mixing chamber having a discharge opening at a discharge end thereof and a jetting chamber extending along the axial center line from said second mixing chamber to said discharge opening, said nozzle tip having an end face portion in which said discharge opening is located having a hemispherical shape and a cylindrical peripheral wall around the base of the hemisphere, said discharge opening being a uniform width slit extending across the hemispherical shape end face portion and into said cylindrical peripheral wall in a diametrically extending plane, the ends of said slit having a V-shape.

* * * * *